US010086228B2

(12) United States Patent
Yoshitake

(10) Patent No.: US 10,086,228 B2
(45) Date of Patent: Oct. 2, 2018

(54) MOUTH OPENING TRAINING DEVICE

(71) Applicant: NATIONAL UNIVERSITY CORPORATION TOKYO MEDICAL AND DENTAL UNIVERSITY, Bunkyo-ku, Tokyo (JP)

(72) Inventor: Hiroyuki Yoshitake, Tokyo (JP)

(73) Assignee: NATIONAL UNIVERSITY CORPORATION TOKYO MEDICAL AND DENTAL UNVIERSITY, Tokyo (JP)

( * ) Notice: Subject to any disclaimer, the term of this patent is extended or adjusted under 35 U.S.C. 154(b) by 497 days.

(21) Appl. No.: 14/654,130

(22) PCT Filed: Dec. 18, 2013

(86) PCT No.: PCT/JP2013/083855

§ 371 (c)(1),
(2) Date: Jun. 19, 2015

(87) PCT Pub. No.: WO2014/098113

PCT Pub. Date: Jun. 26, 2014

(65) Prior Publication Data

US 2015/0314163 A1 Nov. 5, 2015

(30) Foreign Application Priority Data

Dec. 19, 2012 (JP) ..... 2012-277456

(51) Int. Cl.
*A63B 23/03* (2006.01)
*A61H 1/02* (2006.01)

(52) U.S. Cl.
CPC ..... *A63B 23/032* (2013.01); *A61H 1/02* (2013.01); *A63B 23/03* (2013.01);
(Continued)

(58) Field of Classification Search
CPC ..... A63B 23/025–23/032; A63B 23/20; A61H 1/02; A61H 2205/026; A61H 2201/1676;
(Continued)

(56) References Cited

U.S. PATENT DOCUMENTS 4,955,367 A * 9/1990 Homsy ..... A61H 1/02 433/215
5,035,420 A * 7/1991 Beeuwkes, III ..... A61H 1/02 482/11

(Continued)

FOREIGN PATENT DOCUMENTS

JP H04009156 A 1/1992
JP 3007372 B2 2/2000

(Continued)

OTHER PUBLICATIONS

Extended European Search Report corresponding to European Patent Application No. 13864000.8-1658/2937071 PCT/JP2013/083855; dated Jul. 7, 2016.

(Continued)

*Primary Examiner* — Nyca T Nguyen
(74) *Attorney, Agent, or Firm* — Cantor Colburn LLP

(57) ABSTRACT

The purpose of the present invention is to provide a mouth-opening training device with which continuous rotational movement and anterior sliding movement of the temporomandibular joint can be performed smoothly, the device thereby being capable of guiding the movement of the mandible so as to trace an actual mandibular mouth-opening movement. The mouth-opening training device is provided with: an upper member, the base end of which is grasped and the tip of which can engage with a user's maxilla; a lower member, the tip of which can engage with the user's mandible and a portion of which is in contact with the upper member so as to allow sliding; and a connecting section for connecting the upper member to the lower member so as to allow sliding and allow opening and closing. As the tip of the upper member is opened with respect to the tip of the lower member, the lower member moves in the direction of the tip.

6 Claims, 13 Drawing Sheets

(52) U.S. Cl.
CPC ..... *A61H 2201/0153* (2013.01); *A61H 2201/1253* (2013.01); *A61H 2201/1604* (2013.01); *A61H 2201/1647* (2013.01); *A61H 2201/1676* (2013.01); *A61H 2205/026* (2013.01)

(58) Field of Classification Search
CPC .... A61H 2201/1604; A61H 2201/1253; A61H 2201/0153; A61H 2201/1647; A61B 17/24; A61B 17/2812; A61B 17/2816; A61B 17/282; A61B 2017/2808
See application file for complete search history.

(56) References Cited

U.S. PATENT DOCUMENTS 5,746,703 A 5/1998 Levatino
5,944,723 A * 8/1999 Colleran ..... A61B 17/8866 606/208
6,080,162 A * 6/2000 Dye ..... A61B 17/1767 606/80
6,558,392 B1 * 5/2003 Martini ..... A61B 17/025 433/140

FOREIGN PATENT DOCUMENTS

JP 2000033104 A 2/2000
JP 2004121756 A 4/2004
JP 2008067836 A 3/2008
JP 4191818 B2 12/2008
JP 4268680 B2 5/2009

OTHER PUBLICATIONS

International Search Report corresponding to Application No. PCT/JP2013/083855; dated Jan. 21, 2014, with English translation.

* cited by examiner

MOUTH OPENING TRAINING DEVICE

This is the U.S. national stage of application No. PCT/JP2013/083855, filed on Dec. 18, 2013. Priority under 35 U.S.C. § 119(a) and 35 U.S.C. § 365(b) is claimed from Japanese Application No. 2012-277456, filed Dec. 19, 2012, the disclosure of which is also incorporated herein by reference.

TECHNICAL FIELD

The present invention relates to a mouth-opening training device, which is used for training the opening and closing of a mouth, in particular, when the mouth cannot be freely opened and closed.

BACKGROUND ART

Conventionally, it has been known that, when mandibular opening and closing movements are impaired by a temporomandibular disorder or fracture of jaw, mandibular opening and closing movements are performed by using a mouth-opening training device to restore the mandibular functions. The human jaws function by a combination of: a rotational movement, in which the mandible rotates in relation to the maxilla around the temporomandibular joint as a fulcrum; and an anterior sliding movement, in which the mandible moves back and forth in relation to the maxilla, when the mandibular condyle of the temporomandibular joint slides back and forth. In line with this, a mouth-opening training device for training both of a rotational movement and an anterior sliding movement of the mandible has been proposed (refer to Patent Document 1).

According to the mouth-opening training device of Patent Document 1, an upper lever in contact with the maxilla is connected to a lower lever in contact with the mandible; the levers are opened and closed in relation to each other around a connecting portion as a fulcrum, thereby training the mouth-opening movements based on a rotational movement of the temporomandibular joint; in which a latching mechanism for moving the lower lever back and forth in relation to the upper lever is provided, so that an anterior sliding movement of the temporomandibular joint can be trained. This latching mechanism is composed of: a handgrip gear portion including a handgrip connected to a gear; and a rack portion engaging with the gear. The lower lever moves back and forth in relation to the upper lever by rotating the handgrip.

In the mouth-opening training device according to Patent Document 1, the upper and lower levers for training the mouth-opening movements based on a rotational movement of the temporomandibular joint are provided separately from the handgrip for training an anterior sliding movement of the temporomandibular joint; therefore, when the device is actually used, the rotational movement and the anterior sliding movement are performed separately as independent movements. Also, since the connecting portion is provided at the center of the rotational movement, the device guides the mandible in an arc that is reverse to the trajectory of the mouth-opening movement of the actual mandible that rotates around the temporomandibular joint.

Patent Document 1: Japanese Unexamined Patent Application, Publication No. 2000-33104

DISCLOSURE OF THE INVENTION

Problems to be Solved by the Invention

In the mouth-opening training device according to Patent Document 1, when attempting to perform a rotational movement and an anterior sliding movement in a continuous manner, the levers and the handgrip need to be operated at the same time. However, since the levers and the handgrip are difficult to be operated at the same time, the operation cannot be smoothly performed, which has been a problem. Furthermore, there has been another problem in that such a rotational movement cannot trace the trajectory of the mouth-opening movement based on the rotation of the actual mandible.

The purpose of the present invention is to provide a mouth-opening training device, with which a continuous rotational movement and an anterior sliding movement of the temporomandibular joint can be performed smoothly, the device thereby being capable of guiding the movement of the mandible so as to trace the trajectory of an actual mandibular mouth-opening movement.

Means for Solving the Problems

A mouth-opening training device of the present invention includes: an upper member, a base end side of which is gripped, and a tip side of which can engage with a user's maxilla; a lower member, a tip side of which can engage with the user's mandible, and a part of which is slidably in contact with the upper member; and a connecting portion for connecting the upper member and the lower member, so as to be slidable, openable and closable; in which the lower member moves to the tip side, as the tip side of the upper member is opened in relation to the tip side of the lower member.

It is preferable that the lower member is configured such that an opening and closing fulcrum of the lower member in relation to the upper member moves to the tip side of the upper member, as the tip side of the upper member is opened in relation to the tip side of the lower member.

It is preferable that the mouth-opening training device further includes: an upper side slope portion, which is formed on a bottom side of the upper member so as to be sloped downward from the tip side towards the base end side of the upper member; and a bulge portion, which is provided on a top surface of the lower member; in which, when the tip side of the upper member is opened in relation to the tip side of the lower member, the bulge portion moves to the tip side while abutting on the upper side slope portion.

It is preferable that the upper member includes: a main body portion; and an upper side slope member, which composes the upper side slope portion, and which is attached to the main body portion in a direction connecting the base end and the tip of the main body portion so as to allow a position thereof to be changed.

It is preferable that the mouth-opening training device further includes an angle adjustment member for adjusting an angle of inclination of a slope plate of the upper side slope member in relation to the main body portion.

It is preferable that the mouth-opening training device further includes an opened angle adjustment mechanism for adjusting a range of an opened angle, at which the tip of the upper member is opened in relation to the tip of the lower member.

It is preferable that the mouth-opening training device further includes: an upper side mouthpiece portion, which is provided to the tip side of the upper member, and which includes a plate surface that can engage with the user's maxillary dentition; and a lower side mouthpiece portion, which is provided to the tip side of the lower member, and which includes a plate surface that can engage with the user's mandibular dentition; in which the lower side mouthpiece portion is coupled to the lower member so as to allow an angle therebetween to be changed.

Effects of the Invention

According to the present invention, it is possible to provide a mouth-opening training device, with which a continuous rotational movement and an anterior sliding movement of the temporomandibular joint can be performed smoothly, the device thereby being capable of guiding the movement of the mandible so as to trace the trajectory of an actual mandibular mouth-opening movement.

PREFERRED MODE FOR CARRYING OUT THE INVENTION

Figure 1:
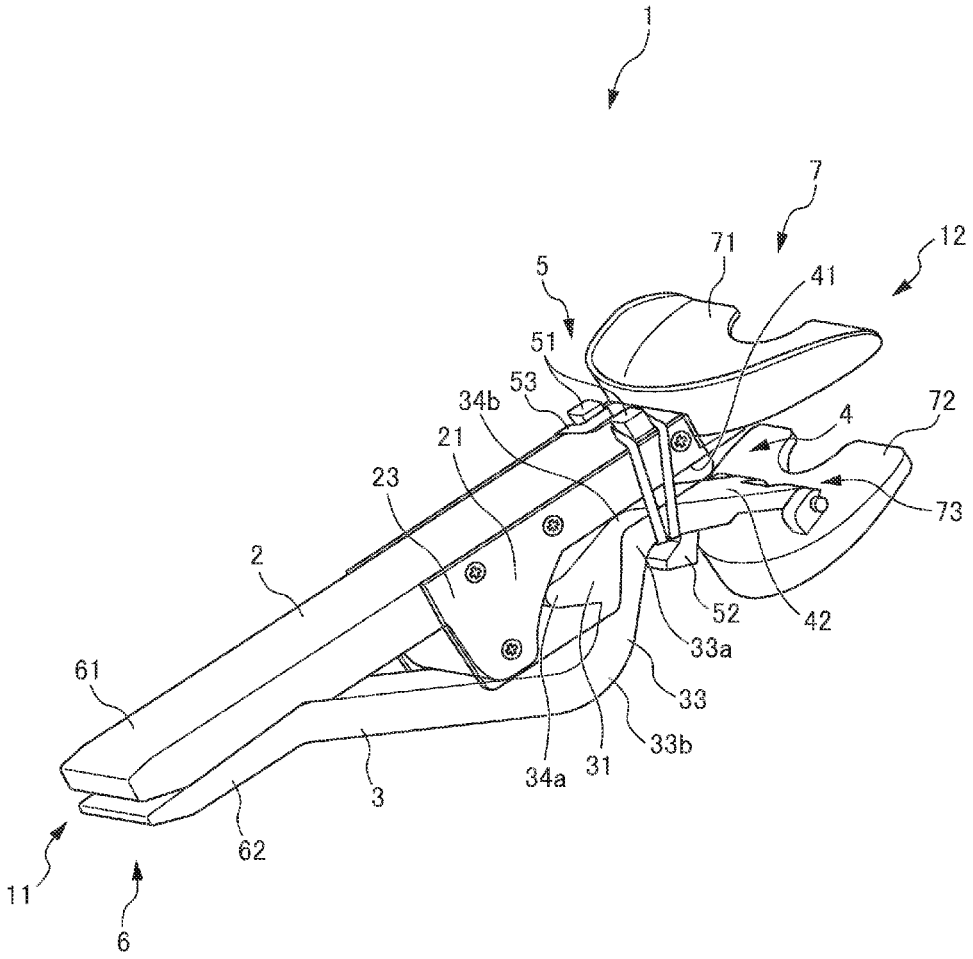
FIG. 1 is a perspective view showing a mouth-opening training device according to a first embodiment of the present invention.
Figure 2:
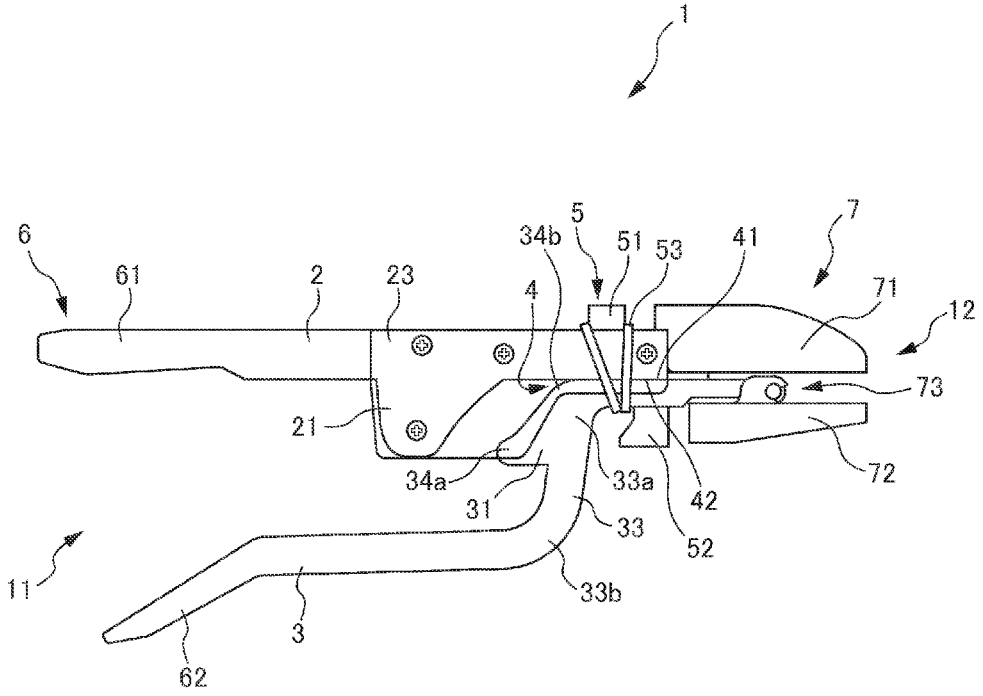
FIG. 2 is a side view of the mouth-opening training device according to the first embodiment.
Figure 3:
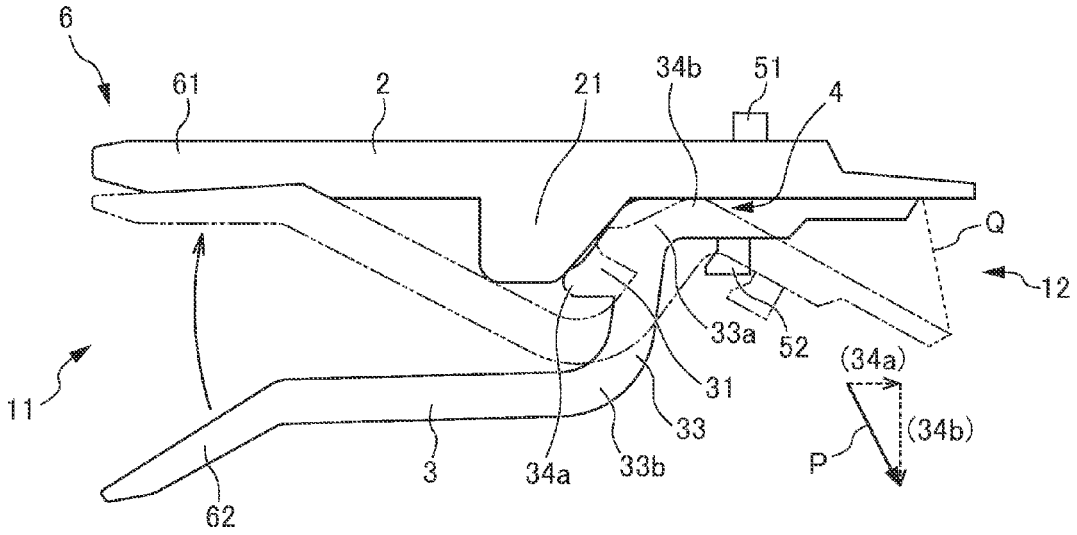
FIG. 3 is a side view of an upper member and a lower member according to the first embodiment.

A first embodiment of the present invention is described below with reference to the drawings. FIG. 1 is a perspective view showing a mouth-opening training device 1 of the first embodiment. FIG. 2 is a side view of the mouth-opening training device 1. FIG. 3 is a side view of an upper member 2 and a lower member 3 of the mouth-opening training device 1.

As shown in FIGS. 1 and 2, the mouth-opening training device 1 has a base end 11 and a tip 12, in which the base end 11 is grasped, and the tip 12 is operated to engage with a user's dentition, thereby training the user's mandibular movement to open and close. The mouth-opening training device 1 is composed mainly of an upper member 2, a lower member 3, and a pair of restriction plates 23. The mouth-opening training device 1 further includes an upper side slope portion 21, a lower side slope portion 31, an abutting portion 4, a connecting portion 5, a gripping portion 6, and an engagement portion 7.

The base end 11 side of the upper member 2 is gripped; and the tip 12 side of the upper member 2 can engage with the user's maxilla. The upper member 2 takes an elongated shape, which extends substantially horizontally from the base end 11 to the tip 12.

The base end 11 side of the lower member 3 is gripped; and the tip 12 side of the lower member 3 can engage with the user's mandible. The lower member 3 in a top view takes an elongated shape, which extends from the base end 11 to the tip 12; and the lower member 3 in a side view has a bent portion 33, which bends at the substantial center in the longitudinal direction of connecting the tip 12 to the base end 11. Specifically, with regard to the lower member 3, two portions extend substantially in parallel at different levels in a side view, and bend so as to approach each other at the substantial center in the longitudinal direction of the lower member 3, and the two portions are connected at the bent portion 33. When the lower member 3 joins the upper member 2, a portion ranging from an upper end 33*a* to the tip 12 side of the bent portion 33 slidably abuts on the upper member 2. The lower member 3 is arranged below the upper member 2, such that a portion ranging from a lower end 33*b* to the base end 11 side of the bent portion 33 is separated below the base end 11 side of the upper member 2.

The upper side slope portion 21 is formed on the bottom surface of the upper member 2, at the substantial center in the longitudinal direction of the upper member 2. The upper side slope portion 21 is formed continuously and integrally with the upper member 2, such that the surface of the upper side slope portion 21 is sloped downward from the tip 12 side to the base end 11 side of the upper member 2, and the base end 11 side of the upper side slope portion 21 protrudes from the upper member 2.

In the vicinities of the side faces of the upper side slope portion 21, the upper side slope portion 21 is interposed by the two restriction plates 23, which extend in the thickness direction of the upper member 2 and the lower member 3. When the lower member 3 slides in relation to the upper member 2, the restriction plates 23 restrict the sliding direction to the longitudinal direction.

The lower side slope portion 31 is formed on the top surface of the lower member 3, at the substantial center in the longitudinal direction of the lower member 3. The lower side slope portion 31 is formed continuously and integrally with the lower member 3, such that the surface of the lower side slope portion 31 is sloped downward from the tip 12 side to the base end 11 side of the lower member 3, and protrudes from the bent portion 33 of the lower member 3. In other words, the lower side slope portion 31 is provided as sloped downward from the upper end 33*a* side to the base end 11 side of the bent portion 33 of the lower member 3.

The lower side slope portion 31 has a bulge portion 34*a*, which is provided so as to bulge from the lower end of the lower side slope portion 31 towards the upper side slope portion 21, beyond the sloped surface of the lower side slope portion 31. Therefore, the lower side slope portion 31 is configured such that, when the lower side slope portion 31 joins the upper side slope portion 21, the sloped surface of the lower side slope portion 31 does not completely coincide with the sloped surface of the upper side slope portion 21.

The lower side slope portion 31 has a curved surface 34*b* to the upper end 33*a* side of the bent portion 33. As shown in FIG. 3, when the tip 12 side of the upper member 2 is opened and separated from the tip 12 side of the lower member 3, the bulge portion 34*a* moves towards the tip 12 side, while touching the upper side slope portion 21; and the curved surface 34*b* serves as a fulcrum (center of rotation) of the opening and closing of the lower member 3.

When the lower member 3 joins the upper member 2, the abutting portion 4 is composed of mutually facing flat planes of the upper member 2 and the lower member 3, in which the planes slidably abut on each other. More specifically, the abutting portion 4 is composed of: an upper side abutting portion 41 provided to the upper member 2; and a lower side abutting portion 42 provided to the lower member 3. The upper side abutting portion 41 is a flat plane, which extends from the starting point of the upper side slope portion 21, sloping from the tip 12 side to the base end 11 side, to the tip 12 side of the upper member 2; and the lower side abutting portion 42 is a flat plane, which extends from the upper end 33*a* of the bent portion 33 to the tip 12 side of the lower member 3.

As shown in FIG. 1, the connecting portion 5 includes: upper side protrusions 51 provided on the top surface of the upper member 2; a lower side protrusion 52 provided on the bottom surface of the lower member; and a rubber 53 as an elastic member. Since the rubber 53 engages with the upper side protrusions 51 and the lower side protrusion 52, the connecting portion 5 connects the upper member 2 and the lower member 3, so as to be slidable, openable and closable at the upper side abutting portion 41 and the lower side abutting portion 42. The upper side protrusions 51 are respectively provided to one side and the other side in the width direction on the top surface of the upper member. The lower side protrusion 52 is provided on the bottom surface of the lower member.

The gripping portion 6 is composed of: an upper-member-side gripping portion 61 provided to the base end 11 side of the upper member 2; and a lower-member-side gripping portion 62 provided to the base end 11 side of the lower member 3. The gripping portion 6 is gripped such that the upper-member-side gripping portion 61 and the lower-member-side gripping portion 62 are brought close to each other. In a state where the upper member 2 joins the lower member 3 at the abutting portion 4, the lower-member-side gripping portion 62 is sloped so as to gradually increase the distance from the upper-member-side gripping portion 61, from a part of the lower member 3 towards the base end 11 side.

As shown in FIGS. 1 and 2, the engagement portion 7 includes an upper side mouthpiece portion 71 and a lower side mouthpiece portion 72, which are provided to the tip 12 side of the upper member 2 and the tip 12 side of the lower member 3, respectively. The upper side mouthpiece portion 71 and the lower side mouthpiece portion 72 take shapes that can engage with the user's maxillary dentition and mandibular dentition, respectively.

The upper side mouthpiece portion 71 has a substantially U-shaped plate surface; and the user's maxillary dentition is placed on this plate surface, and can be fixed thereto by way of a dental paste 74 or the like (to be described later).

The lower side mouthpiece portion 72 has a substantially U-shaped plate surface; and the user's mandibular dentition can be fixed to this plate surface by way of the dental paste 74 or the like (to be described later). As shown in FIGS. 1 and 2, the lower side mouthpiece portion 72 is connected to the tip 12 side of the lower member 3 by way of a hinge 73 so as to allow the angle therebetween to be changed.

Figure 4:
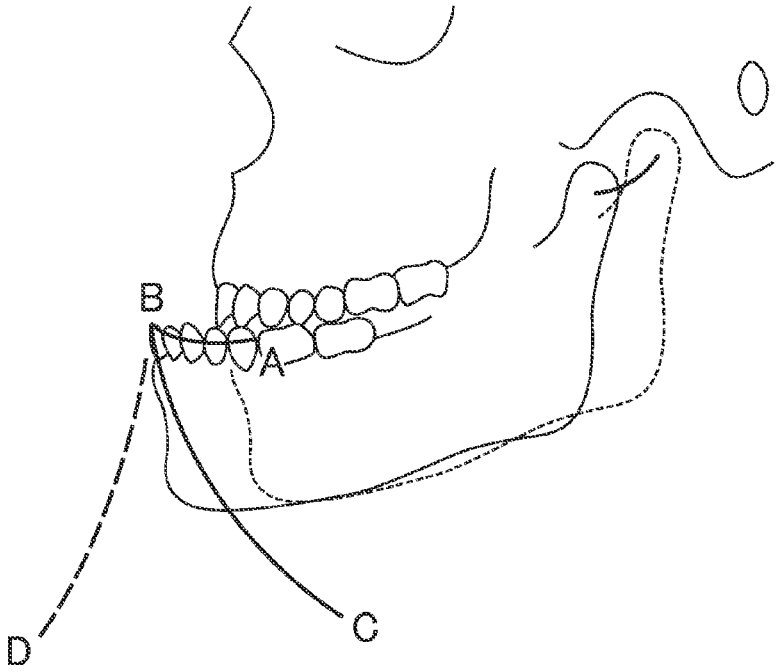
FIG. 4 is a diagram showing trajectories of movement, including positional limits in a rotational movement and an anterior sliding movement of an actual mandible.
Figure 5:
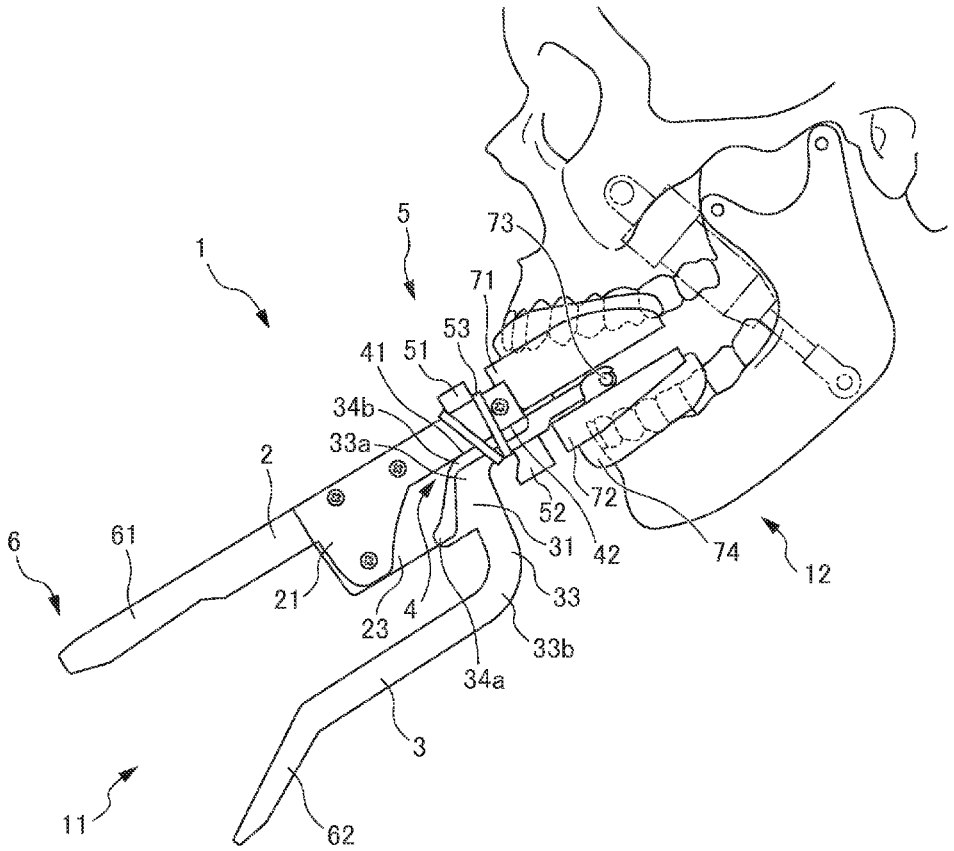
FIG. 5 is a diagram showing a usage state of the mouth-opening training device according to the first embodiment.
Figure 6:
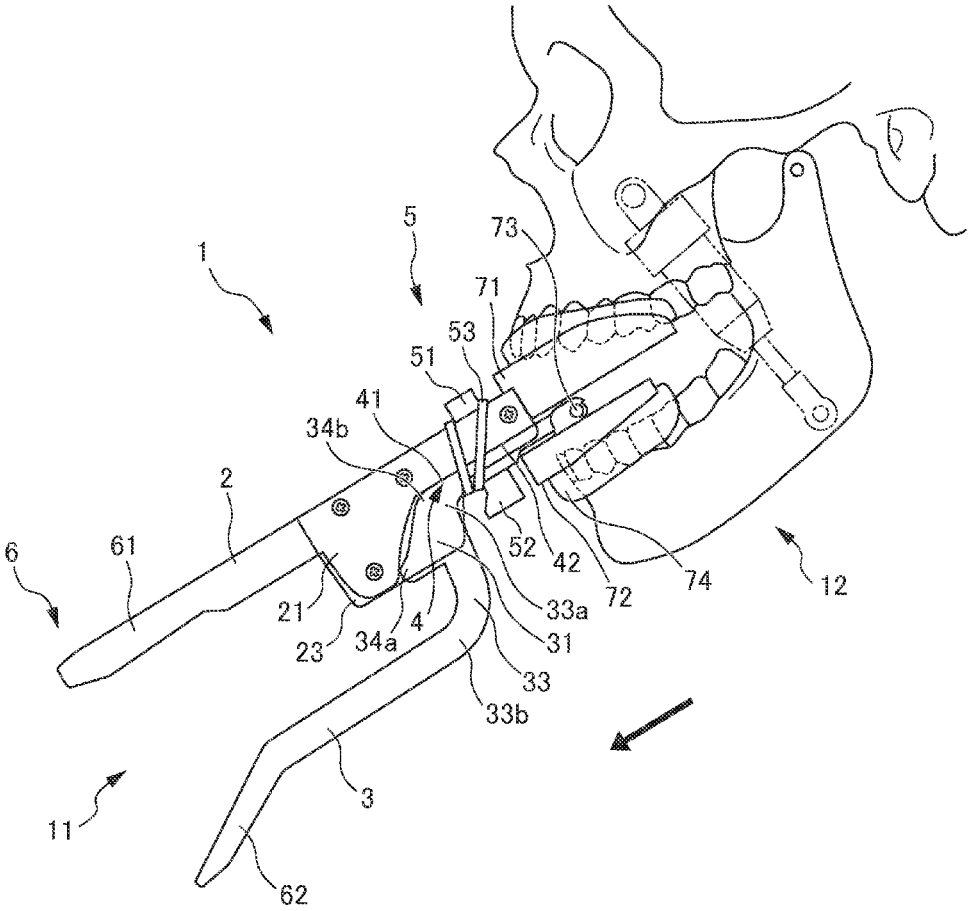
FIG. 6 is a diagram showing a usage state of the mouth-opening training device according to the first embodiment.
Figure 7:
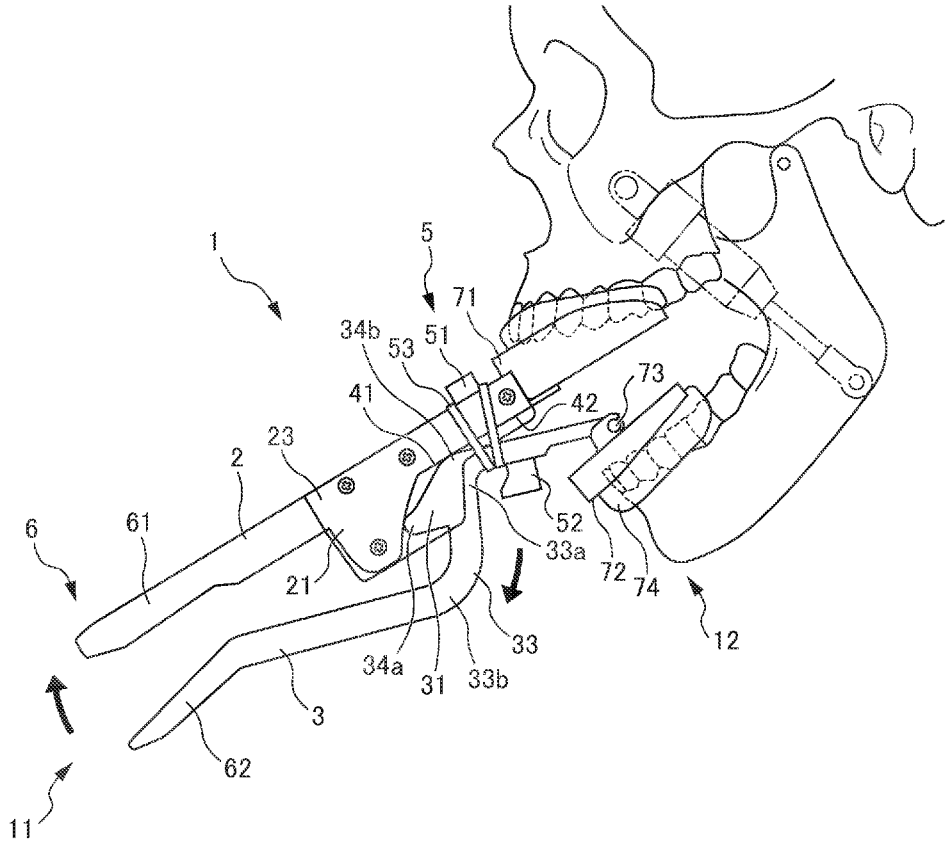
FIG. 7 is a diagram showing a usage state of the mouth-opening training device according to the first embodiment.

Next, operations of the mouth-opening training device 1 of the first embodiment are described with reference to FIGS. 3 and 4, as well as FIGS. 5 to 7. FIG. 4 is a diagram showing trajectories of movement, including positional limits of the mandible in a rotational movement and an anterior sliding movement of the actual temporomandibular joint. FIG. 5 is a diagram showing a first position of the mouth-opening training device 1. FIG. 6 is a diagram showing a second position of the mouth-opening training device 1. FIG. 7 is a diagram showing a state of gradually opening the jaws from the second position. FIGS. 5 to 7 are diagrams of the states where the user's jaw is opened from the closed state, showing from the first position, the second position, and the state where the jaw is opened.

As shown in FIG. 4, by way of anterior sliding movement of the temporomandibular joint, in a state where the maxillary and mandibular dentitions are in contact with each other, the actual mandible can be moved forward from a point A, and can be jutted to a point B, which is the most anterior position in the range of allowing the anterior sliding. When the temporomandibular joint is rotated from the point B, which is the limit position of the anterior sliding movement, the mandible is opened, drawing a circular arc leading to a point C. Namely, the limit position of the mandibular mouth-opening movement, which combines the sliding movement and the rotational movement of the actual temporomandibular joint, follows a trajectory of motion from the point A via the point B to the point C.

The mouth-opening training device 1 is capable of tracing the trajectory of motion through the points A, B to C in this manner. Usage states and operations of the mouth-opening training device 1 are specifically described below.

By engaging the engagement portion 7 with the user's maxillary and mandibular dentitions, the mouth-opening training device 1 is mounted and fixed with a dental paste 74 or the like shown in FIGS. 5 to 7.

As shown in FIG. 5, in the first position, the tip 12 side of the upper member 2 is closed in relation to the tip 12 side of the lower member 3. In the first position, the position of the tip 12 side of the upper member 2 substantially coincides with the position of the tip 12 side of the lower member 3. In the first position, the lower side slope portion 31 is positioned closer to the tip 12 side of the mouth-opening training device 1, than the upper side slope portion 21. Therefore, the upper side slope portion 21 is separated from the lower side slope portion 31. In the first position, the user's mandible is located to the back side (dorsal side) at the point A shown in FIG. 4.

As shown in FIG. 6, in a state where the lower member 3 abuts on the upper member 2 in the abutting portion 4, the lower member 3 slides to the base end 11 side from the first position (the point A in FIG. 4) to the second position. In the second position, the lower member 3 slides to the base end 11 side; as a result, the lower side slope portion 31 approaches the upper side slope portion 21, and the bulge portion 34 of the lower side slope portion 31 comes in contact with the upper side slope portion 21. At this time, the upper side mouthpiece portion 71 and the lower side mouthpiece portion 72 are proximally closed in relation to each other. As the lower member 3 slides to the base end 11 side, the mandible, which is connected to the lower side mouthpiece portion 72, slides forward in the direction of arrow. With the mandibular anterior movement (displacement), the temporomandibular joint also slides forward. When the bulge portion 34 comes in contact with the upper side slope portion 21, the mandible is at the point B shown in FIG. 4. Therefore, when the lower member 3 slides from the first position shown in FIG. 5 to the second position shown in FIG. 6, the points A to B shown in FIG. 4 are traced.

Next, as shown in FIGS. 3 and 7, the gripping portion 6 is gripped in the second position (the point B in FIG. 4); and the base end 11 side of the lower member 3 is brought close to the base end 11 side of the upper member 2. As a result, the bulge portion 34*a* moves towards the tip 12 side, while in contact with the upper side slope portion 21; and the tip 12 side of the upper member 2 is opened in relation to the tip 12 side of the lower member 3 around the curved surface 34*b* as the opening and closing fulcrum (rotational center). More specifically, as a result of moving the base end 11 side of the lower member 3 to approach the base end 11 side of the upper member, the bulge portion 34*a* slides and moves while abutting on the upper side slope portion 21 from a lower portion (from the base end 11 side) to an upper portion (to the tip 12 side) of the upper side slope portion 21. The upper side slope portion 21 is sloped downward from the tip 12 side to the base end 11 side of the upper member 2. Therefore, when the bulge portion 34*a* moves from the lower portion to the upper portion of the upper side slope portion 21, the curved surface 34*b* (the opening and closing fulcrum serving as the rotational center of the lower member 3) is moved towards the user's jaws, from the base end 11 side to the tip 12 side, in the longitudinal direction of mouth-opening training device 1. The lower member 3 moves to the tip 12 side by this operation.

The lower member 3 rotates around the curved surface 34*b*. Therefore, as shown in FIG. 3, a dotted arrow, showing the horizontal movement of the bulge portion 34*a* to the tip 12 side, is combined with another dotted arrow, showing the downward opening movement around the curved surface 34*b* as a fulcrum; the lower member 3 rotates in a direction of a solid arrow P; and the tip 12 side of the lower member 3 follows a trajectory of motion as shown by a dotted line Q. As a result, as shown in FIG. 7, the lower side mouthpiece portion 72 rotates towards the mandibular back side, so as to push back the user's mandible, which has moved forward by the anterior sliding of the temporomandibular joint. Therefore, when the lower member 3 is opened as shown in FIG. 7 from the second position as shown in FIG. 6, a trajectory of rotation is traced from the point B to the point C as shown in FIG. 4.

As described above, when the gripping portion 6 is gripped, the tip of the mouth-opening training device 1 is opened to push down and push back the mandible. Therefore, as the tip 12 side of the mouth-opening training device 1 is opened, the user's mandible rotates around the temporomandibular joint as a fulcrum, and opens along the trajectory of rotation from the point B to the point C as shown in FIG. 4.

In the mouth-opening training device 1 of the first embodiment, when the application of the force for gripping the gripping portion 6 is subsequently ceased, the elasticity of the rubber 53 broadens the gap between the base end 11 side of the lower member 3 and the base end 11 side of the upper member 2 to return to the first position, and narrows the gap between the lower side mouthpiece portion 72 and the upper side mouthpiece portion 71. By the operation of returning the gripping portion 6, the user's mandible rotates in the direction of closing around the temporomandibular joint as a fulcrum. At this time, the mandible moves while rotating from the point C to the point A as shown in FIG. 4.

According to the mouth-opening training device 1 of the first embodiment, the following effects are achieved.

(1) The mouth-opening training device 1 is provided with: the upper member 2 and the lower member 3 of the mouth-opening training device 1, which engage with the user's maxilla and mandible, respectively; and the connecting portion 5 for connecting the upper member 2 and the lower member 3 so as to be slidable, openable and closable; in which the lower member 3 moves to the tip side, as the tip side of the upper member 2 is opened in relation to the tip side of the lower member 3. Therefore, the sliding movement of the upper member 2 and the lower member 3 allows the user's jaw to slide forward, and to be rotated around the temporomandibular joints of maxilla and mandible as a fulcrum, in a continuous and smooth manner.

(2) The lower member 3 is configured such that, as the tip side of the upper member 2 is opened in relation to the tip side of the lower member 3, the opening and closing fulcrum of the lower member 3 in relation to the upper member 2 moves to the tip side of the upper member 2. In the mouth-opening training device according to Patent Document 1, the connecting portion serving as the center of rotational movement is fixed, does not move towards the user's jaw unlike the curved surface 34*b* of the mouth-opening training device 1, cannot trace a trajectory of rotation of the actual mandible, and tracks a trajectory from the point B to the point D as shown in FIG. 4. However, according to the mouth-opening training device 1 of the first embodiment, as the tip side of the upper member 2 is opened in relation to the tip side of the lower member 3, the opening and closing fulcrum of the lower member 3 moves to the tip side of the upper member 2; therefore, the device can be opened along the trajectory of rotation from the point B to the point C as shown in FIG. 4. Therefore, the user's mandible having slid forward can be rotated towards the mandibular back side while being pushed back, so as to trace the trajectory of rotation of the actual mandible.

(3) The upper side slope portion 21 is provided to the bottom side of the upper member 2 so as to be sloped downward from the tip 12 side towards the base end 11 side of the upper member 2; and the bulge portion 34 is provided on the top surface of the lower member 3. When the tip 12 side of the upper member 2 is opened in relation to the tip 12 side of the lower member 3 from the second position, the bulge portion 34 moves to the tip 12 side while abutting on the upper side slope portion 21. Since the bulge portion 34 can move and slide on the sloped surface of the upper side slope portion 21, the gap between the tip 12 side of the lower member 3 and the tip 12 side of the upper member 2 can be expanded, while pushing the lower member 3 to the tip 12 side.

(4) The upper side mouthpiece portion 71, which can engage with the user's maxillary dentition, is provided to the tip 12 side of the upper member 2; and the lower side mouthpiece portion 72, which can engage with the user's mandibular dentition, is provided to the tip 12 side of the lower member 3. The upper side mouthpiece portion 71 and the lower side mouthpiece portion 72 take shapes respectively corresponding to the dentitions; therefore, load concentration on a particular tooth can be prevented.

(5) The lower side mouthpiece portion 72 is coupled to the lower member 3 so as to allow an angle therebetween to be changed. Therefore, change in angle of the occlusal plane of the mandibular dentition by the mouth-opening movement can be followed; and load concentration on a particular tooth can be prevented.

Figure 8A:
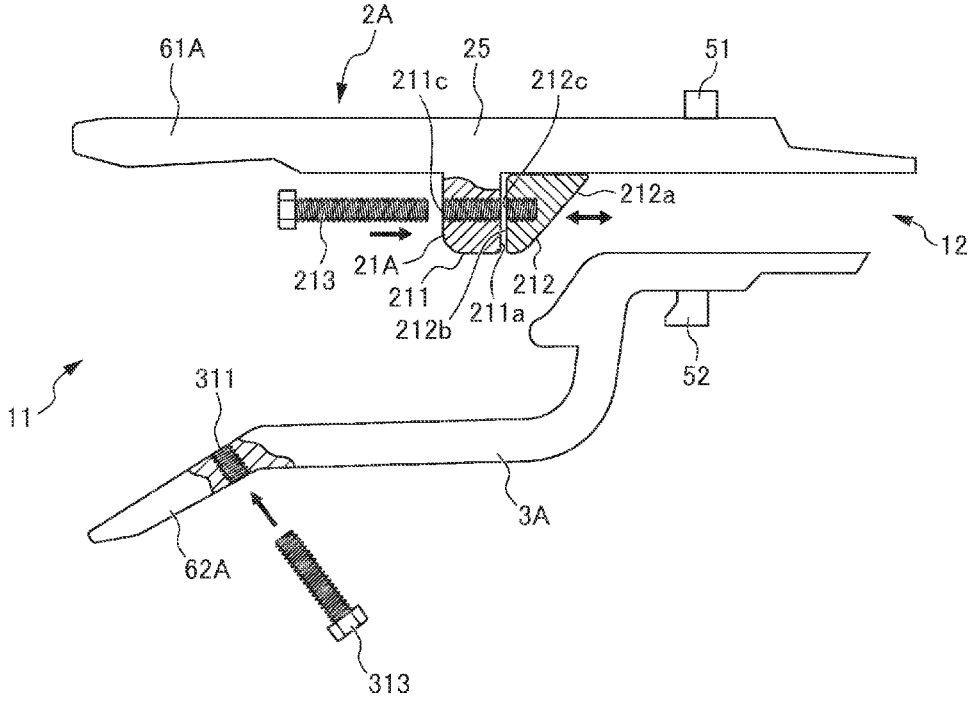
FIG. 8A is a side view of an upper member and a lower member according to a second embodiment.
Figure 8B:
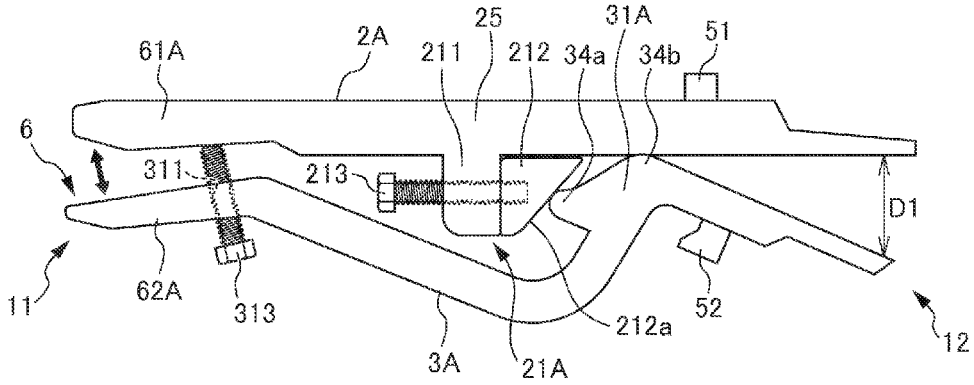
FIG. 8B is a diagram showing a usage state of FIG. 8A.

Next, a mouth-opening training device 1A according to a second embodiment of the present invention is described with reference to FIGS. 8A and 8B. FIG. 8A is a side view showing an upper member 2A and a lower member 3A of the mouth-opening training device 1A of the second embodiment. FIG. 8B is a side-view showing a state where base ends 11 of the upper member 2A and the lower member 3A in FIG. 8A are brought close to each other.

Note that, in describing the second and subsequent embodiments, the same constituent features are assigned with the same reference numbers, descriptions of which are omitted or simplified.

In the second embodiment, a part of the upper side slope portion 21A is separately formed, which is a difference from the first embodiment. In the second embodiment, an opened angle adjustment mechanism is further provided for adjusting the range of the opened angle between the tip of the upper member 2A and the tip of the lower member 3A, which is a difference from the first embodiment.

As shown in FIG. 8A, the upper member 2A of the second embodiment has: a main body portion 25; and an upper side slope portion main body 211 and an upper side slope member 212, which compose a part of the upper side slope portion 21A.

The lower member 3A of the second embodiment has a screw hole 311 and a screw 313, which serve as the opened angle adjustment mechanism.

The main body portion 25 composes a main portion of the upper member 2A, and extends from the base end 11 side to the tip 12 side.

The upper side slope portion 21A is composed of: an upper side slope portion main body 211, which is formed integrally with, and continuously from, the upper member 2A; an upper side slope member 212, which is detachably in contact with the upper side slope portion main body 211; and a screw 213, which connects the upper side slope portion main body 211 and the upper side slope member 212.

The upper side slope portion main body 211 takes a substantially rectangular shape in a side view, and has a tip surface 211*a* to the tip 12 side, which is perpendicular to a direction in which the main body portion 25 of the upper member 2 extends. The upper side slope portion main body 211 has a screw hole 211*c*, which penetrates through the upper side slope portion main body 211, and which extends in parallel with the direction in which the main body portion 25 extends.

The upper side slope member 212 has: a proximal end surface 212*b* to the base end 11 side, which joins the tip surface 211*a* of the upper side slope portion main body 211; and a sloped surface 212*a*, which is sloped downward from the tip 12 side of the upper member 2 towards the lower end of the proximal end surface 212*b*. The upper side slope member 212 has a screw hole 212*c*, which continues to the screw hole 211*c* of the upper side slope portion main body 211, when the proximal end surface 212*b* joints the tip surface 211*a* of the upper side slope portion main body 211. The screw hole 212*c* of the upper side slope member 212 does not penetrate through the upper side slope member 212. The upper side slope member 212 is provided with a mechanism (not shown) for allowing the screw 213 to spin around when the screw 213 is inserted into the screw hole 212*c*.

The screw hole 311 is provided so as to penetrate the lower-member-side gripping portion 62A from the bottom side of to the top side thereof in a vertical direction (thickness direction). The screw 313 has a shaft that is longer than the thickness of the lower-member-side gripping portion 62A.

Next, operations of the mouth-opening training device 1A of the second embodiment are described.

In the upper member 2A, the screw 213 is inserted into the screw hole 211*c* from the base end 11 side to the tip 12 side of the upper side slope portion main body 211. Furthermore, the screw 213 penetrates through the upper side slope portion main body 211, and is inserted into the screw hole 212*c* of the upper side slope member 212, thereby connecting the upper side slope portion main body 211 and the upper side slope member 212. When the upper side slope member 212 is inserted into the screw hole 212*c*, a shaft end of the screw 213 is advanced or retreated to move the upper side slope member 212 in a longitudinal direction of the upper member 2, thereby changing the position of the upper side slope member 212.

When the position of the upper side slope member 212 is changed, the distance of sliding the lower member 3A in relation to the upper member 2A is adjusted. Specifically, in a state where the tip surface 211*a* of the upper side slope portion main body 211 is in contact with the proximal end surface 212*b* of the upper side slope member 212, when the lower member 3A slides to the base end 11 side, the bulge portion 34 moves to the base end 11 side, and abuts on the upper side slope member 212. On the other hand, in a case in which the tip surface 211*a* of the upper side slope portion main body 211 is separated from the proximal end surface 212*b* of the upper side slope member 212, and the upper side slope member 212 is arranged in a position closer to the tip 12 side of the upper member 2A, when the lower member 3A slides to the base end 11 side, the bulge portion 34 moves to the tip 12 side, and abuts on the upper side slope member 212. Therefore, when the distance to separate the tip surface 211*a* of the upper side slope portion main body 211 from the proximal end surface 212*b* of the upper side slope member 212 is adjusted by way of the screw 213, thereby sliding the lower member 3A to the base end 11 side, the distance of sliding the mandible is adjusted. It is preferable that the distance of sliding the lower member 3A in relation to the upper member 2A is adjusted to about 10 mm.

In the lower member 3A, the screw 313 is inserted into the screw hole 311, from the under surface to the top surface of the lower-member-side gripping portion 62A; and the shaft of the screw 313 is penetrated therethrough. Since the screw 313 is threadedly engaged with a groove provided in the screw hole 311, the screw 313 is advanced or retreated to adjust the insertion length that is the length of the shaft protruding from the lower-member-side gripping portion 62A.

As shown in FIG. 8B, the insertion length of the shaft is adjusted to restrict the closed angle, at which the base end 11 side of the upper member 2A is closed in relation to the base end 11 side of the lower member 3A, when the gripping portion 6 is gripped. The closed angle is reduced by lengthening the insertion length of the shaft; and the closed angle is increased by shortening the insertion length of the shaft. The closed angle, at which the base end 11 side of the upper member 2A is closed in relation to the base end 11 side of the lower member 3A, is restricted to adjust the range of the opened angle, at which the tip 12 side of the upper member 2A is opened in relation to the tip 12 side of the lower member 3A. It is preferable that the opened angle is adjusted, such that a distance D1 between the tip 12 of the upper member 2A and the tip 12 of the lower member 3A is about 45 mm to 50 mm.

According to the mouth-opening training device 1A of the second embodiment, the following effects are achieved, in addition to the effects achieved by the first embodiment.

(6) The upper member 2A is composed by including: the main body portion 25; and the upper side slope member 212, which composes a part of the upper side slope portion 21A, and which is attached in the longitudinal direction of the main body portion 25 such that the position thereof can be changed. The position of the upper side slope member 212 is changed in the longitudinal direction; therefore, the position, where the bulge portion 34A of the lower member 3A abuts on the upper side slope portion 21A, moves in the longitudinal direction of the upper member 2A. Therefore, in a case of sliding the lower member 3A to the base end 11 side, the range of guiding the anterior sliding of the temporomandibular joint is adjusted, thereby making it possible to adjust the quantity of the forward movement of the user's mandible that engages with the mouth-opening training device 1A.

(7) The opened angle adjustment mechanism is provided, which adjusts the range of the opened angle between the tip of the upper member 2A and the tip of the lower member 3A. For example, the opened angle adjustment mechanism is composed by including: the screw hole 311, which penetrates through the vertical direction, and which is provided to the base end 11 side of the upper member 2A or the base end 11 side of the lower member 3A; the screw 313, which is inserted into the screw hole 311, and which restricts the closed angle between the base end 11 side of the upper member 2A and the base end 11 side of the lower member 3A; and the adjustment mechanism for adjusting the insertion length of the screw 313 into the screw hole 311. The screw 313 is inserted into the screw hole 311, thereby restricting the closed angle, at which the base end 11 side of the upper member 2A is closed in relation to the base end 11 side of the lower member 3A. The closed angle is restricted, thereby making it possible to adjust the range of the opened angle, at which the tip 12 side of the upper member 2A is opened in relation to the tip 12 side of the lower member 3A.

Figure 9A:
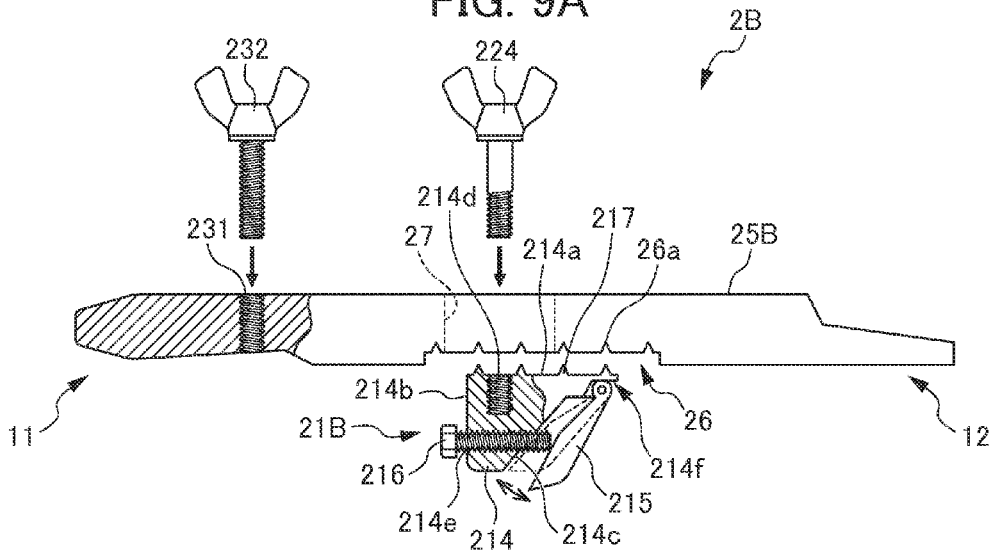
FIG. 9A is a side view of an upper member and a lower member according to a third embodiment.
Figure 9B:
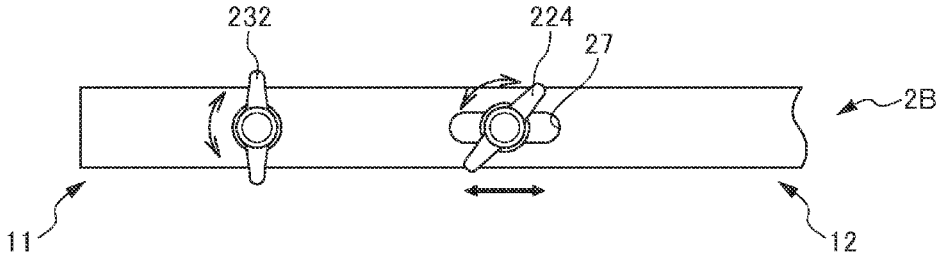
FIG. 9B is a top plan view of FIG. 9A.
Figure 9C:
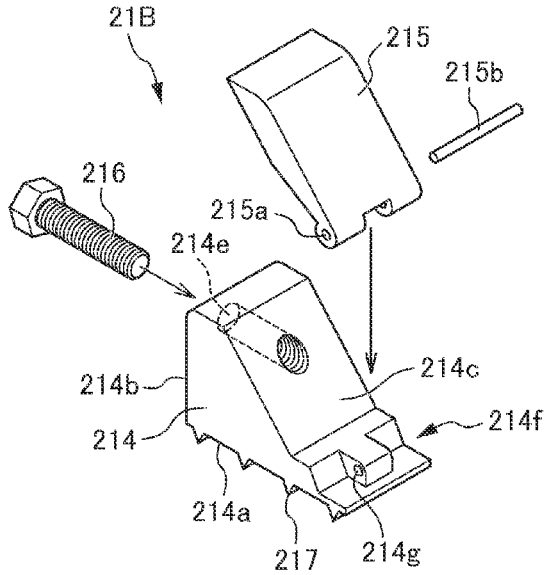
FIG. 9C is a perspective view showing elements on larger scale of FIG. 9A.
Figure 9D:
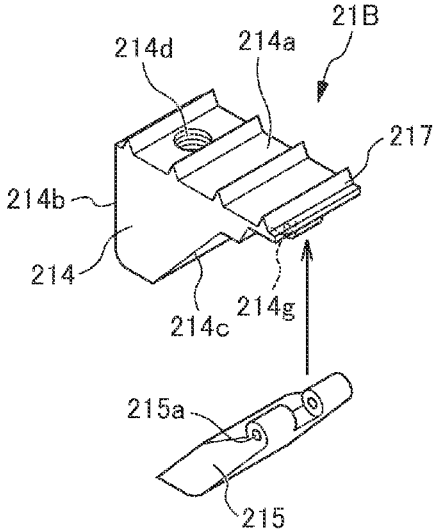
FIG. 9D is a perspective view vertically reversing FIG. 9C.

Next, a mouth-opening training device 1B according to a third embodiment of the present invention is described with reference to FIGS. 9A to 9D. FIG. 9A is a side view showing an upper member 2B of the mouth-opening training device 1B of the third embodiment. An upper side protrusion 51 and a lower side protrusion 52 are omitted in the drawing. FIG. 9B is a top plan view of FIG. 9A. FIG. 9C is a perspective view of an upper side slope portion 21. FIG. 9D is a perspective view of the upper side slope portion 21 of FIG. 9C, observed from another perspective.

Note that, in describing the third and subsequent embodiments, the same constituent features are assigned with the same reference numbers, descriptions of which are omitted or simplified.

In the third embodiment, an upper side slope portion 21B is formed separately from an upper member 2B, and the upper side slope portion 21B includes a slope plate 215, which are differences from the first and second embodiments. In the third embodiment, a restriction member of an opened angle adjustment mechanism is provided to the upper member 2B side, which is a difference from the second embodiment.

The upper member 2B of the third embodiment has: a main body portion 25B; a fixing member 214 and the slope plate 215, which compose the upper side slope portion 21B; an angle adjustment screw 216 as an angle adjustment member; and a screw hole 231 and a screw 232 as the opened angle adjustment mechanism.

As shown in FIG. 9B, the main body portion 25B has an elongated slot 27 penetrating through the thickness direction, at the substantial center in the longitudinal direction. As shown in FIG. 9A, the main body portion 25B has a concave portion 26, which hollows to the top side in the vicinity of the elongated slot 27, on the bottom side at the substantial center in the longitudinal direction. The main body portion 25 has a plurality of notches 26*a*, which are formed in the concave portion 26 and extend in the width direction, at a certain interval in the longitudinal direction of the main body portion 25B.

The main body portion 25B has a screw hole 231, which is formed in the base end 11 side, and which penetrates through the vertical direction.

The fixing member 214 has: a top surface 214*a*, which is in contact with the under surface of the main body portion 25B; a proximal end surface 214*b*, which is located to the base end 11 side, and which is substantially perpendicular to a direction in which the main body portion 25B extends; and a sloped surface 214*c*, which is located to the tip 12 side, and which is sloped downward from the tip 12 side to the base 11 end side of the main body portion 25B. The fixing member 214 has a plurality of bumps 217, which are provided on the top surface 214*a*, and which correspond to the plurality of notches 26*a* of the main body portion 25B.

The fixing member 214 has a protrusion 214*f*, which protrudes from the upper end of the sloped surface 214*c* to the tip 12 side. The protrusion 214*f* is provided with a hinge hole 214*g*, which extends in the width direction of the main body portion 25B.

The fixing member 214 is provided with a fixing screw hole 214*d*, which is provided to the top surface 214*a*, and which is formed in the vertical direction. The fixing member 214 has a screw hole 214*e*, which is formed substantially in parallel with the direction in which the main body portion 25B extends. The fixing screw 224 threadedly engages with the fixing screw hole 214*d*, thereby connecting the fixing member 214 to the main body portion 25B.

The slope plate 215 is arranged to the tip 12 side of the fixing member 214, along the slope of the sloped surface 214*c*. As shown in FIGS. 9C and 9D, the slope plate 215 has a hinge hole 215*a* to the upper end, through which a pin 215*b* passes coaxially with the hinge hole 214*g* formed in the protrusion 214*f* of the fixing member 214, thereby establishing hinge connection therebetween. The slope plate 215 forms a sloped surface of the upper side slope portion 21B.

The screw hole 231 penetrates through the vertical direction (thickness direction) of the upper member 2B. The screw 232 is inserted into the screw hole 231.

Next, operations of the mouth-opening training device 1B of the third embodiment are described.

As shown in FIG. 9A, in the upper member 2B, the top surface 214*a* is abutted on the concave portion 26 of the upper member 2B; and the bumps 217 on the top surface 214*a* are aligned with the notches 26*a* of the concave portion 26. When the alignment is finished, the fixing screw 224 is threadedly engaged with the fixing screw hole 214*d*, thereby establishing fixation. The concave portion 26 is formed within a certain range in the longitudinal direction, on the under surface of the upper member 2B; therefore, the position of the fixing member 214 can be changed to the tip 12 side or the base end 11 side in the longitudinal direction of the upper member 2B, as appropriate.

In a state where the fixing member 214 is fixed, the angle adjustment screw 216 threadedly engages with and penetrates through the screw hole 214*e* of the fixing member. The angle adjustment screw 216 penetrates through the screw hole 214*e*, and protrudes from the sloped surface 214*c* of the fixing member 214. Since the angle adjustment screw 216 protrudes from the fixing member 214, the angle adjustment screw 216 pushes the slope plate 215 so as to be moved to the tip 12 side. This adjusts the angle of inclination of the slope plate 215 in relation to the main body portion 25B.

Since the angle adjustment screw 216 protrudes from the fixing member 214, the lower end of the slope plate 215 moves to the tip 12 side, and the angle of inclination of the slope plate 215 in relation to the main body portion 25B is increased to approach 90 degrees in relation to the upper member 2B, in the side view. When the angle of inclination is increased, a bulge portion 34B of a lower member 3B is more likely to move at the tip 12 side of the upper member 2B, than in the case of a small angle of inclination. In a case in which the lower member 3B slides to the base end 11 side, when the angle of inclination is increased, the lower member 3B is more likely to come in contact with the upper member 2B at the tip 12 side, than in the case of a small angle of inclination.

In the lower member 3A, the screw 232 is inserted into the screw hole 231, from the top surface to the under surface of the upper member 2B; and the shaft of the screw 232 is penetrated therethrough. Since the screw 232 is threadedly engaged with a groove provided in the screw hole 231, the screw 232 is advanced or retreated to adjust the insertion length that is the length of the shaft protruding from the upper member 2B.

The insertion length of the shaft of the screw 232 is adjusted to restrict the closed angle, at which the base end 11 side of the upper member 2B is closed in relation to the base end 11 side of the lower member 3B, when the gripping portion 6 is gripped. The closed angle is reduced by lengthening the insertion length of the shaft; and the closed angle is increased by shortening the insertion length of the shaft. The closed angle, at which the base end 11 side of the upper member 2B is closed in relation to the base end 11 side of the lower member 3B, is restricted to adjust the opened angle, at which the tip 12 side of the upper member 2B is opened in relation to the tip 12 side of the lower member 3B. It is preferable that the opened angle is adjusted, such that a distance D1 between the tip 12 of the upper member 2B and the tip 12 of the lower member 3B is about 45 mm to 50 mm.

According to the mouth-opening training device 1B of the third embodiment, the following effects are achieved, in addition to the effects achieved by the first and second embodiments.

(8) The angle adjustment screw 216 is provided, which adjusts the angle of inclination of the slope plate 215 in relation to the main body portion 25B. By increasing the angle of inclination of the slope plate 215, it is possible to increase the movement distance of the mandible to the tip 12 side, which is pushed by the lower member 3B, and it is also possible to reduce the quantity of the anterior sliding of the mandible and the temporomandibular joint.

Figure 10:
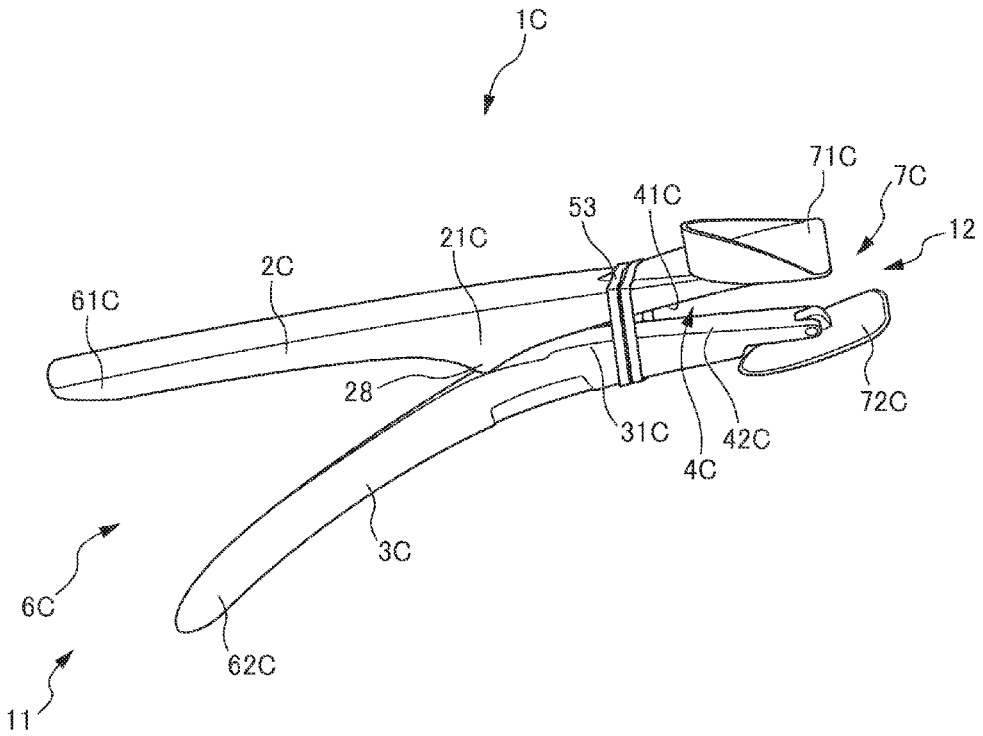
FIG. 10 is a perspective view of a mouth-opening training device according to a fourth embodiment.

Next, a mouth-opening training device 1C according to a fourth embodiment of the present invention is described with reference to FIGS. 10 to 13. FIG. 10 is a perspective view showing the mouth-opening training device 1C of the fourth embodiment.

Note that, in describing the fourth embodiment, the same constituent features are assigned with the same reference numbers, descriptions of which are omitted or simplified.

The mouth-opening training device 1C of the fourth embodiment differs in the shape of each member from those of the first to third embodiments. In particular, the entirety of a lower member 3C is formed in a gentle arc, warping from the substantial center in the longitudinal direction to the tip 12 side and the base end 11 side, which is a difference from the first to third embodiments.

As shown in FIG. 10, an upper side slope portion 21C slightly protrudes from the under surface of an upper member 2C. The upper side slope portion 21C is sloped downward, from the tip 12 side of the under surface of the upper member 2C, to the substantial center in the longitudinal direction, and has the most protruding apex 28 at the substantial center in the longitudinal direction.

A lower side slope portion 31C is formed, such that a certain range of the top surface of the lower member 3C from the tip 12 to the substantial center in the longitudinal direction warps and slopes. A step hollowing downward is formed in the base end 11 side of the lower side slope portion 31C.

When the lower member 3C joins the upper member 2C, the abutting portion 4C is composed of mutually facing flat planes of the tip 12 side of the upper member 2C and the lower member 3C.

A connecting portion 5C includes a rubber 53C. The rubber 53C slidably connects the upper member 2C and the lower member 3C.

A gripping portion 6C is composed of: an upper-member-side gripping portion 61C provided to the base end 11 side of the upper member 2C; and a lower-member-side gripping portion 62C provided to the base end 11 side of the lower member 3C. The lower-member-side gripping portion 62C is gently curved downward, from the substantial center in the longitudinal direction to the base end 11 of the lower member 3C.

An engagement portion 7 includes an upper side mouthpiece portion 71C and a lower side mouthpiece portion 72C, which are provided to the tip 12 side of the upper member 2C, and the tip 12 side of the lower member 3C, respectively. The upper side mouthpiece portion 71C and the lower side mouthpiece portion 72C take a semilunar shape, which can engage with the user's maxillary and mandibular dentitions.

Figure 11:
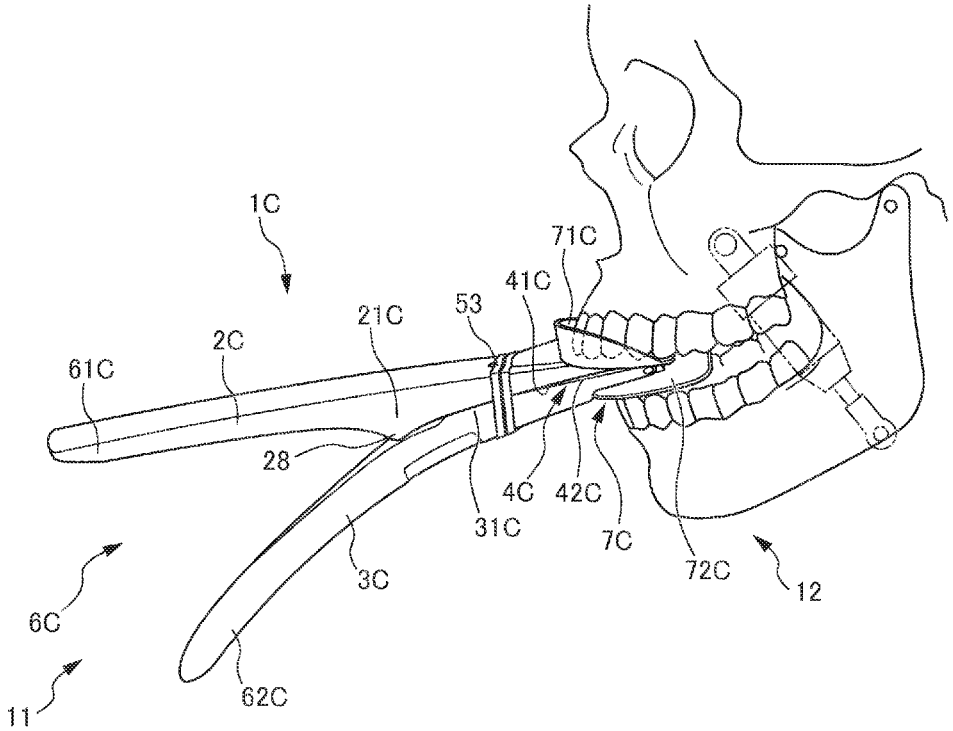
FIG. 11 is a diagram showing a usage state of the mouth-opening training device according to the fourth embodiment.
Figure 12:
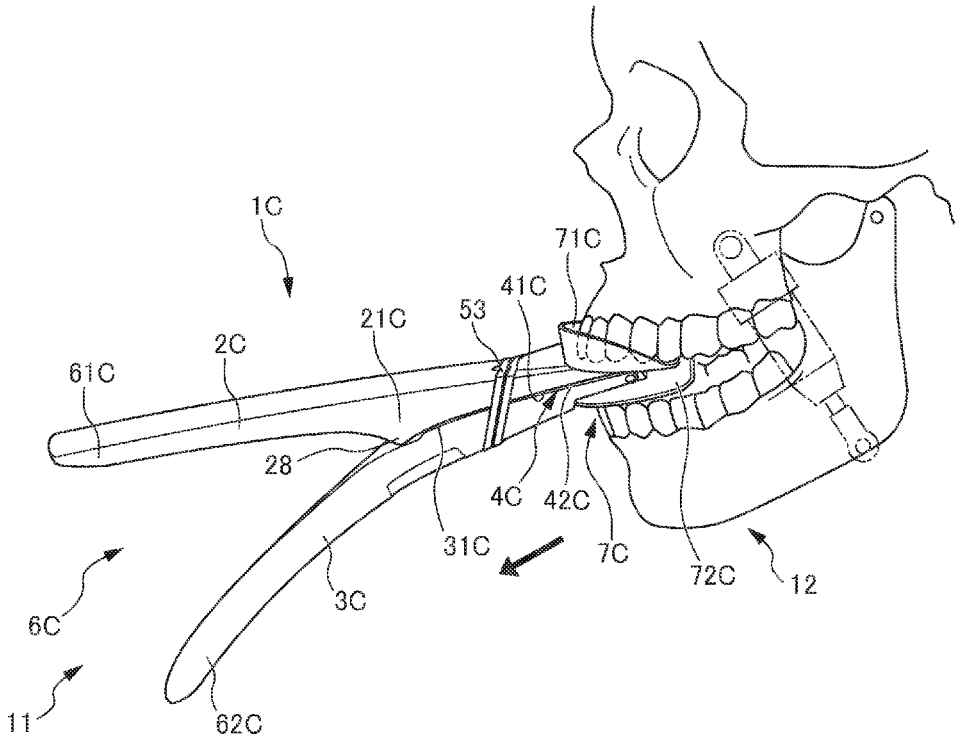
FIG. 12 is a diagram showing a usage state of the mouth-opening training device according to the fourth embodiment.
Figure 13:
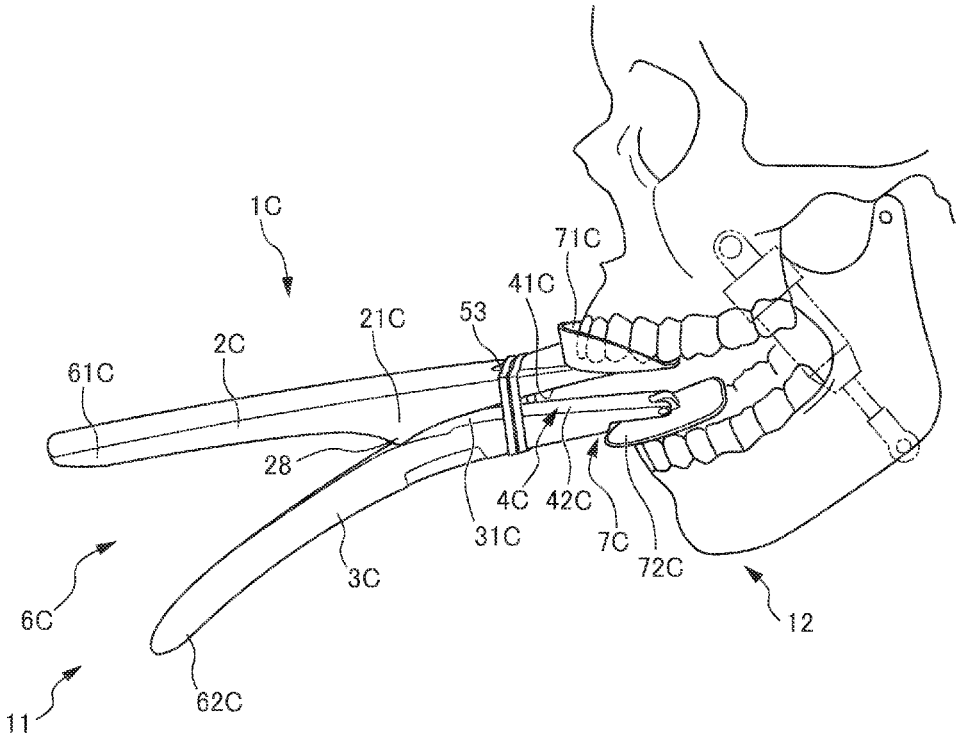
FIG. 13 is a diagram showing a usage state of the mouth-opening training device according to the fourth embodiment.

Next, operations of the mouth-opening training device 1C of the fourth embodiment are described with reference to FIGS. 11 to 13. FIG. 11 is a diagram showing a first position of the mouth-opening training device 1C. FIG. 12 is a diagram showing a second position of the mouth-opening training device 1C. FIG. 13 is a diagram showing a state of gradually opening the jaws from the second position.

By engaging the engagement portion 7C with the user's maxillary and mandibular dentitions, the mouth-opening training device 1C is mounted and fixed with a dental paste or the like (not shown).

As shown in FIG. 11, in the first position, the tip 12 side of the upper member 2 is closed in relation to the tip 12 side of the lower member 3. In the first position, the lower side slope portion 31C is positioned closer to the tip 12 side of the mouth-opening training device 1C, than the upper side slope portion 21C. Therefore, the upper side slope portion 21C is separated from the lower side slope portion 31C. In the first position, the user's mandible is located to the back side (dorsal side).

As shown in FIG. 12, in a state where the lower member 3C abuts on the upper member 2C at the abutting portion 4C, the lower member 3C slides to the base end 11 side, from the first position to the second position. In the second position, the lower member 3C slides to the base end 11 side; as a result, the lower side slope portion 31C approaches the upper side slope portion 21C. At this time, the upper side mouthpiece portion 71C and the lower side mouthpiece portion 72C are closed and in contact with each other. As the lower member 3C slides to the base end 11 side, the mandible, which is connected to the lower side mouthpiece portion 72C, slides forward in the direction of arrow. As the mandible slides, the temporomandibular joint also moves forward.

As shown in FIG. 13, the gripping portion 6C is gripped in the second position; and the base end 11 side of the lower member 3C is brought close to the base end 11 side of the upper member 2C. In the fourth embodiment, the tip 12 side of the upper member 2C is opened in relation to the tip 12 side of the lower member 3C, in which the apex 28 of the upper side slope portion 21C serves as a fulcrum of rotation of the lower member 3C. At this time, the lower-member-side gripping portion 62C is pushed to the tip 12 side, with a thumb or palm touching the lower-member-side gripping portion 62C. As the base end 11 side of the lower member 3C approaches the base end 11 side of the upper member, the lower-member-side gripping portion 62 of the lower member 3C slides and moves to the tip 12 side, while abutting on the apex 28 of the upper side slope portion 21C. Therefore, the lower side mouthpiece portion 72C is rotated in an arc to the back side of the mandible, so as to push the user's mandible out.

According to the fourth embodiment, operation/working-effects similar to those of the first embodiment are achieved.

The preferred embodiments of the present invention have been described above; however, the present invention is not limited to the embodiments described above, and can be modified as appropriate.

For example, in the first to third embodiments, the sloped surface of the upper side slope portion 21 is flat, and takes a linear shape in the side view. However, the surface may take a circular arc shape (the surface of the upper side slope portion 21 is dented in an arc), such that the angle of tilt is gradually decreased from the lower portion (the base end 11 side) towards the upper portion (the tip 12 side) of the upper side slope portion 21. The trajectory of motion of the lower member 3 is determined by the angle of tilt of the upper side slope portion 21; and if the angle of tilt is constant, the trajectory of motion will follow a straight line (refer to the dotted line Q) as shown in FIG. 3. Therefore, the trajectory of motion can follow an arc, by gradually decreasing the angle of tilt of the upper side slope portion 21 so as to take an arc shape. Therefore, the trajectory of rotation can completely trace the arc from the point B to the point C as shown in FIG. 4.

Also, for example, in the embodiments described above, the upper side mouthpiece portion is formed integrally with, and continuously to, the upper member; however, the present invention is not limited thereto. The upper side mouthpiece portion may be formed separately from the upper member, and be connected to the upper member. In the embodiments described above, the upper side mouthpiece portion and the lower side mouthpiece portion take a U-shape or semilunar shape, but are not limited in particular, as long as the portions take a shape corresponding to the user's dentition. For example, the upper side mouthpiece portion and the lower side mouthpiece portion may take a shape of a fan or clam.

The upper side slope portion 21A is composed of the fixing member 214 and the slope plate 215 in the third embodiment, but may be formed of a single member as in the second embodiment.

EXPLANATION OF REFERENCE NUMERALS

1, 1A, 1B, 1C mouth-opening training device
2, 2A, 2B, 2C upper member
3, 3A, 3B, 3C lower member
5, 5A, 5B, 5C connecting portion
11 base end
12 tip
21, 21A, 21B, 21C upper side slope portion
25B main body portion
31, 31A, 31B, 31C lower side slope portion
34 bulge portion
51 upper side protrusion
52 upper side protrusion
53, 53C elastic member
71, 71C upper side mouthpiece portion
72, 72C lower side mouthpiece portion
212 upper side slope member
214 fixing member
215 slope plate
216 angle adjustment member
311, 231 through-hole
313, 232 restriction member

The invention claimed is:

1. A mouth-opening training device, comprising:
an upper member, a base end side of the upper member being gripped, and a tip side of the upper member being configured to engage with a user's maxilla;
a lower member, a tip side of the lower member being configured to engage with the user's mandible, and a part of the lower member being slidably in contact with the upper member;
a connecting portion for connecting the upper member and the lower member, so as to be slidable, openable and closable; and
an opening and closing fulcrum of the lower member where the lower member rotates relative to the upper member;
a bulge portion provided in a position away from the opening and closing fulcrum; and
a slope portion to which the bulge portion abuts;
wherein the bulge portion abuts and slides on the slope portion to move the lower member away from the tip side of the upper member, and
the lower member rotates around the opening and closing fulcrum, the fulcrum moving toward the tip side of the upper member, increasing an interval between the tip side of the lower member and the tip side of the upper member as the tip side of the upper member is opened.

2. The mouth-opening training device according to claim 1, wherein
the slope portion is an upper side slope portion, which is formed on a bottom side of the upper member so as to be sloped downward from the tip side towards the base end side of the upper member; and
the bulge portion is provided on a top surface of the lower member;
wherein, when the tip side of the upper member is opened in relation to the tip side of the lower member, the bulge portion moves to the tip side of the upper member while abutting on the upper side slope portion.

3. The mouth-opening training device according to claim 2,
wherein the upper member includes:
a main body portion; and
an upper side slope member, which composes the upper side slope portion, and which is attached to the main body portion in a direction connecting the base end side and the tip side of the main body portion so as to allow a position thereof to be changed.

4. The mouth-opening training device according to claim 3, further comprising:
an angle adjustment member for adjusting an angle of inclination of a slope plate of the upper side slope member in relation to the main body portion.

5. The mouth-opening training device according to claim 1, further comprising:

an opened angle adjustment mechanism for adjusting a range of an opened angle, at which the tip side of the upper member is opened in relation to the tip side of the lower member.

6. The mouth-opening training device according to claim 1, further comprising:

an upper side mouthpiece portion, which is provided to the tip side of the upper member, and which includes a plate surface configured to engage with the user's maxillary dentition; and a lower side mouthpiece portion, which is provided to the tip side of the lower member, and which includes a plate surface configured to engage with the user's mandibular dentition;

wherein the lower side mouthpiece portion is coupled to the lower member so as to allow an angle therebetween to be changed.

* * * * *